United States Patent [19]

Kobayashi et al.

[11] Patent Number: 4,648,370

[45] Date of Patent: Mar. 10, 1987

[54] METHOD AND APPARATUS FOR CONTROLLING AIR-FUEL RATIO IN INTERNAL COMBUSTION ENGINE

[75] Inventors: Nobuyuki Kobayashi; Takashi Hattori, both of Toyota, Japan

[73] Assignee: Toyota Jidosha Kabushiki Kaisha, Toyota, Japan

[21] Appl. No.: 730,207

[22] Filed: May 3, 1985

[30] Foreign Application Priority Data

May 7, 1984 [JP] Japan ..... 59-89247

[51] Int. Cl.[4] ..... F02M 51/00; F02D 9/06

[52] U.S. Cl. ..... 123/489; 123/325; 123/326; 123/440

[58] Field of Search ..... 123/493, 489, 480, 440, 123/325

[56] References Cited

U.S. PATENT DOCUMENTS

| | | | |
|---|---|---|---|
| 3,669,083 | 6/1972 | Fort | 123/325 |
| 3,670,706 | 6/1972 | Fujisawa | 123/325 |
| 4,365,603 | 12/1982 | Shikita et al. | 123/493 |
| 4,385,596 | 5/1983 | Hosaka | 123/493 |
| 4,416,237 | 11/1983 | Aoki et al. | 123/493 |
| 4,434,269 | 3/1984 | Otobe et al. | 123/493 |
| 4,437,442 | 3/1984 | Yamaguchi | 123/493 |
| 4,437,446 | 3/1984 | Isomura et al. | 123/493 |
| 4,466,413 | 8/1984 | Oonishi et al. | 123/493 |
| 4,476,834 | 10/1984 | Nakazato | 123/440 |
| 4,489,693 | 12/1984 | Matsuzaki | 123/440 |
| 4,489,696 | 12/1984 | Kobayashi et al. | 123/493 |
| 4,491,115 | 1/1985 | Otobe et al. | 123/493 |
| 4,492,211 | 1/1985 | Shimomura et al. | 123/440 |
| 4,510,902 | 4/1985 | Tsuchida et al. | 123/493 |
| 4,510,911 | 4/1985 | Otobe | 123/493 |
| 4,528,956 | 7/1985 | Ogata et al. | 123/440 |
| 4,558,672 | 12/1985 | Boccadoro et al. | 123/326 |

*Primary Examiner*—Raymond A. Nelli

*Attorney, Agent, or Firm*—Cushman, Darby & Cushman

[57] ABSTRACT

In an internal combustion engine wherein feedback control of the air-fuel ratio is carried out in accordance with the concentration of a specific composition in the exhaust gas, so that the air-fuel ratio is close to an predetermined target air-fuel ratio on the lean side with respect to the stoichiometric air-fuel ratio, the rate of fuel cut-off for a definite time period is calculated. When the rate of fuel cut-off is larger than a predetermined value, the air-fuel feedback control is stopped.

6 Claims, 13 Drawing Figures

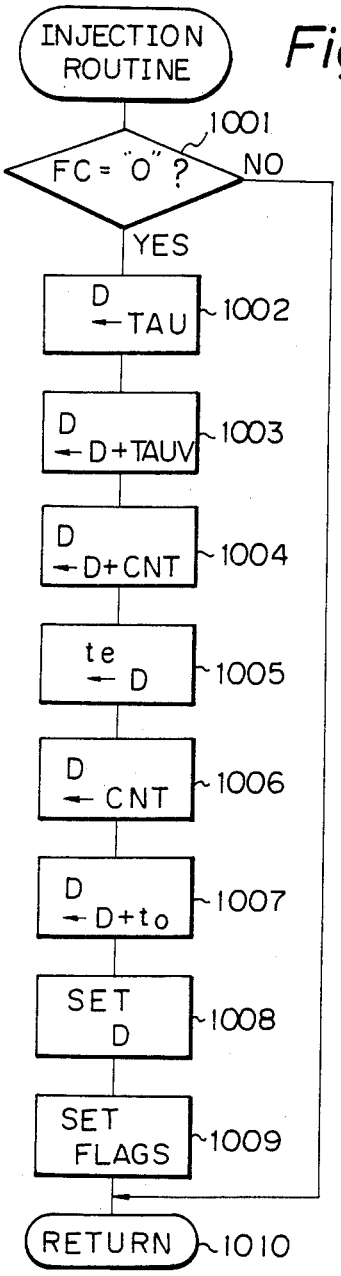
Fig. 10
Fig. 11
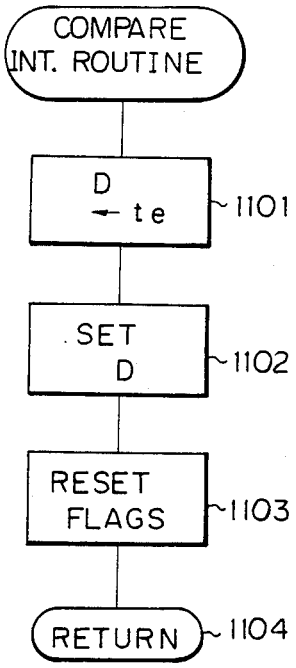

METHOD AND APPARATUS FOR CONTROLLING AIR-FUEL RATIO IN INTERNAL COMBUSTION ENGINE

BACKROUND OF THE INVENTION

1. Field of the Invention

The present invention relates to a method and apparatus for feedback control of the air-fuel ratio in an internal combustion engine.

2. Description of the Related Art

As measures taken against exhaust gas pollution and fuel consumption, a lean burn system has recently been developed. According to this lean burn system, a lean mixture sensor is provided for generating an analog current in proportion to the air-fuel mixture on the lean side in an exhaust pipe of an engine. Thus, the feedback of the air-fuel ratio of the engine can be controlled by using the analog output of the lean mixture sensor, thereby attaining an arbitrary air-fuel ratio on the lean side.

The above-mentioned lean mixture sensor always has a definite voltage applied thereto, thereby generating a limit current in linear proportion to the oxygen concentration in the exhaust gas. In order to maintain this linear characteristic of the limit current of the lean mixture sensor to the oxygen concentration, it is necessary to maintain the element temperature of the lean mixture sensor at higher than 650° C. For this purpose, a heater is conventionally incorporated into the lean mixture sensor.

However, even if the lean mixture sensor is heated by the heater, when fuel cut-off is often carried out the element temperature of the lean mixture sensor may become lower then 650° C., reducing the output level of the lean mixture sensor. As a result, the air-fuel ratio is determined by the lean mixture sensor to be on the rich side as compared with the actual air-fuel ratio. Thus, when the air-fuel ratio feedback control further advances, the controlled air-fuel ratio becomes leaner, thus inviting misfires, surging, and the like.

Note that the fuel cut-off is activated to stop the injection of fuel during deceleration, thereby improving fuel consumption. The control of the fuel cut-off depends upon the opening of a throttle valve, the engine speed, and the like. For example, when the throttle valve is completely closed and the engine speed is higher than the required fuel cut-off engine speed, the fuel cut-off is activated. Contrary to this, when the throttle valve is not completely closed, or when the engine speed is lower than the required fuel cut-off recovery engine speed, the fuel cut-off is released. In this case, the fuel cut-off engine speed is higher than the fuel cut-off recovery engine speed, thereby obtaining the hysteresis characteristics of the engine speed. In addition, both the fuel cut-off engine speed and the fuel cut-off recovery engine speed are dependent upon engine state parameters such as the coolant temperature of the engine. In addition, the fuel cut-off is usually one of the air-fuel feedback control conditions, and therefore, the air-fuel ratio feedback control operation is not carried out during a fuel cut-off mode.

SUMMARY OF THE INVENTION

It is an object of the present invention to provide a method and apparatus for controlling the air-fuel ratio in an internal combustion engine which prevents the controlled air-fuel ratio from being on the lean side, thus avoiding misfires, surging and the like.

According to the present invention, in an internal combustion engine wherein feedback control of the air-fuel ratio is carried out in accordance with the concentration of a specific composition in the exhaust gas, so that the air-fuel ratio is close to an aimed air-fuel ratio on the lean side with respect to the stoichiometric air-fuel ratio, the rate of the fuel cut-off time in a definite time period is calculated. When the rate of the fuel cut-off time is larger than a predetermined value, the air-fuel feedback control is stopped.

BRIEF DESCRIPTION OF THE DRAWINGS

The present invention will be more clearly understood from the description as set forth below with reference to the accompanying drawings, wherein:

FIGS. 3, 5, and 7 to 11 are flow charts showing the operation of the control circuit of FIG. 1;

DESCRIPTION OF THE PREFERRED EMBODIMENTS

Figure 1:
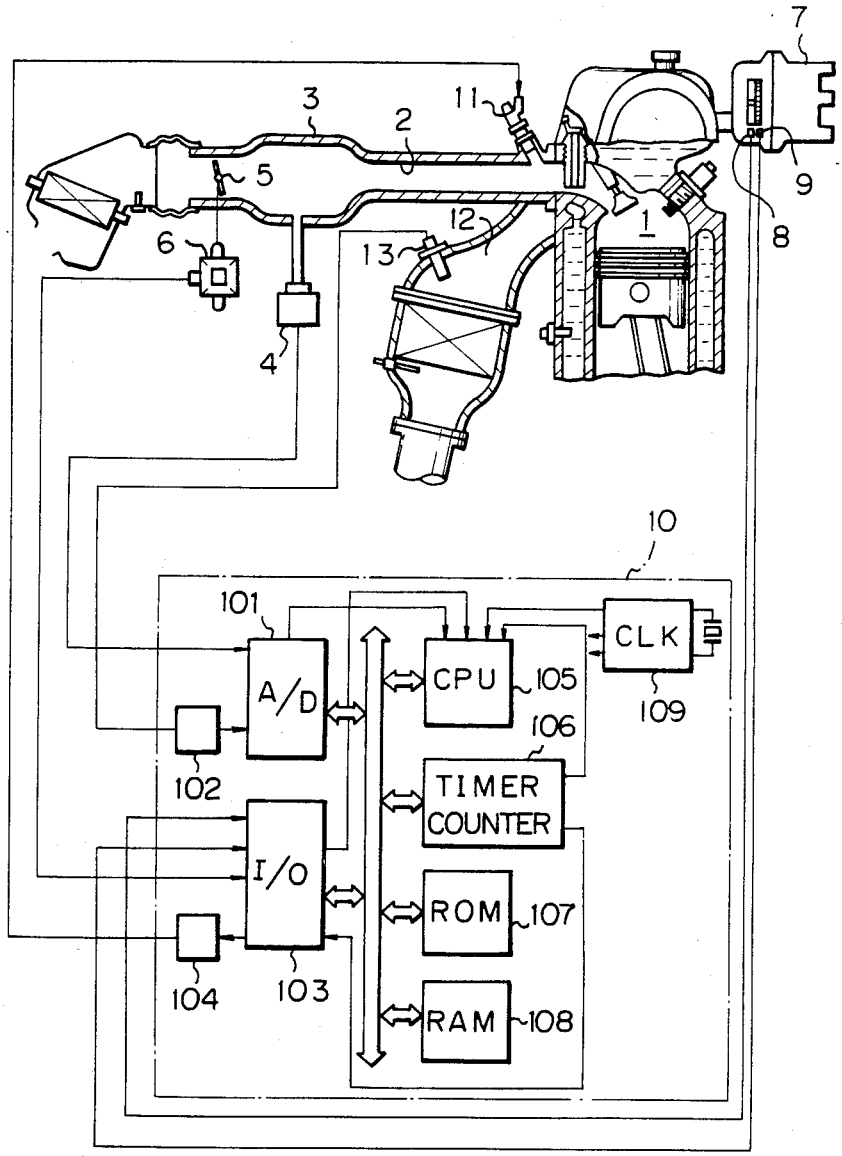
FIG. 1 is a schematic diagram of an internal combustion engine according to the present invention.

In FIG. 1, which illustrates an internal combustion engine according to the present invention, reference numeral 1 designates a four-cycle spark ignition engine disposed in an automotive vehicle. Provided in an air-intake passage 2 of the engine 1 is a surge tank 3 in which a pressure sensor 4 is provided. The pressure sensor 4 is used for detecting the absolute pressure within the intake-air passage 2 and transmits its output signal to a multiplexer-incorporating analog-to-digital (A/D) converter 101 of a control circuit 10.

Provided in a throttle valve 5 of the intake air passage 2 is an idle switch 6 for detecting whether or not the throttle valve is completely closed. The output of the idle switch is supplied to an input/output (I/O) interface 103 of the control circuit 10.

Disposed in a distributor 57 are crank angle sensors 8 and 9 for detecting the angle of the crankshaft (not shown) of the engine 1. In this case, the crankangle sensor 8 generates a pulse signal at every 720° crank angle (CA) while the crank-angle sensor 9 generates a pulse signal at every 30° CA. The pulse signals of the crank angle sensors 8 and 9 are supplied to the I/O interface 103 of the control circuit 10. In addition, the pulse signal of the crank angle sensor 9 is then supplied to an interruption terminal of a central processing unit (CPU) 105.

Additionally provided in the air-intake passage 2 is a fuel injector 11 for supplying pressurized fuel from the fuel system (not shown) to the air-intake port of the cylinder of the engine 1. In this case, other fuel injectors are also provided for other cylinders, though not shown in FIG. 1.

Figure 2:
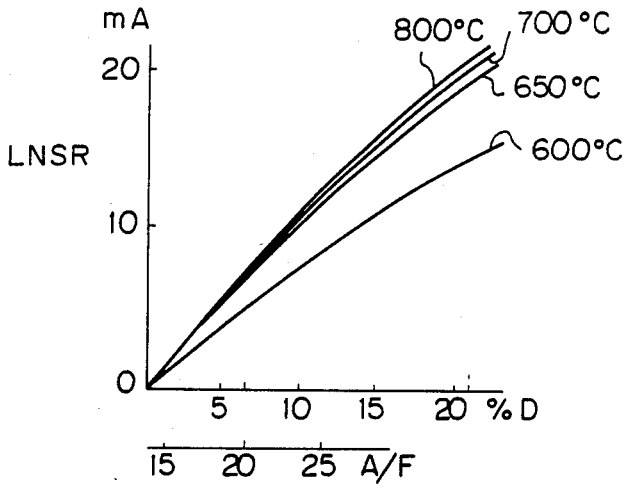
FIG. 2 is a graph showing the output characteristics of the lean mixture sensor of FIG. 1.

Provided in an exhaust gas passage 12 of the engine 1 is a lean mixture sensor 13 for detecting the concentration of oxygen composition in the exhaust gas. The lean mixture sensor 13 generates a current signal LNSR as shown in FIG. 2 and transmits it a via a current-to-voltage converter circuit 102 of the control circuit 10 to the A/D converter 101 thereof.

The control circuit 10, which may be constructed by a microcomputer, includes a driver circuit 104 for driving the fuel injector 11, a timer counter 106, a read-only memory (ROM) 107 for storing a main routine, interrupt routines such as a fuel injection routine, an ignition timing routine, tables (maps), constants, etc., a random access memory 108 (RAM) for storing temporary data, a clock generator 109 for generating various clock signals, and the like, in addition to the A/D converter 101, the current-to-voltage converter circuit 102, the I/O interface 103, and the CPU 105.

The timer counter 106 may include a free-running counter, a compare register, a comparator for comparing the content of the free-run counter with that of the compare register, flag registers for compare interruption, injection control, and the like. Of course, the timer counter 106 also may include a plurality of compare registers and a plurality of comparators. In this case, the timer counter 106 is used for controlling the injection start and end operation.

Interruptions occur at the CPU 105 when the A/D converter 101 completes an A/D conversion and generates an interrupt signal; when the crank angle sensor 9 generates a pulse signal; when the timer counter 106 generates a compare interrupt signal; and when the clock generator 109 generates a special clock signal.

The pressure data PM of the pressure sensor 4 and the limit current data LNSR of the lean mixture sensor 13 are fetched by an A/D conversion routine executed at every predetermined time period and are then stored in the RAM 108. That is, the data PM and LNSR in the RAM 108 are renewed at every predetermined time period. The engine rotational speed $N_e$ is calculated by an interrupt routine executed at 30° CA, i.e, at every pulse signal of the crank angle sensor 9, and is then stored in the RAM 108.

In FIG. 2, which shows the output characteristics of the lean mixture sensor 13 of FIG. 1, it is assumed that a definite voltage is applied to the lean mixture sensor 13. As shown in FIG. 2, as the oxygen concentration D in the exhaust gas increases, that is, as the air-fuel ratio A/F increases, the limit current LNSR also increases. In this case, when the element temperature of the lean mixture sensor 13 becomes lower than 650° C., the lean mixture sensor 13 enters a non-activating state, thus reducing its limit current LNSR. For avoiding this, as explained above, a heater is provided within the interior of the lean mixture sensor 13, thereby maintaining the element temperature thereof at a temperature higher than 650° C. However, when fuel cut-off is often carried out and the temperature of the exhaust gas is reduced, it is difficult to maintain the element at a temperature higher than 650° C. even by heating the heater. In the present invention, the rate of fuel cut-off is monitored. When this rate becomes a predetermined value, the air-fuel ratio feedback control by using the output LNSR of the lean mixture sensor 13 is stopped, which will be explained later in more detail.

Figure 3:
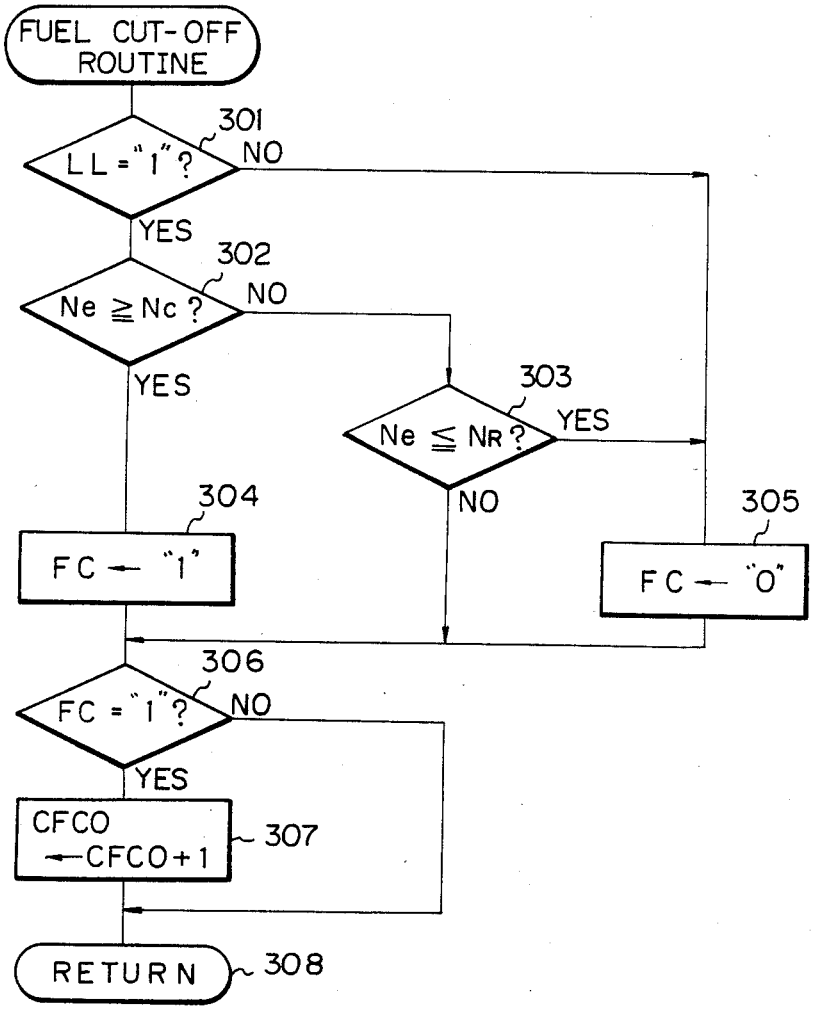
Figure 4:
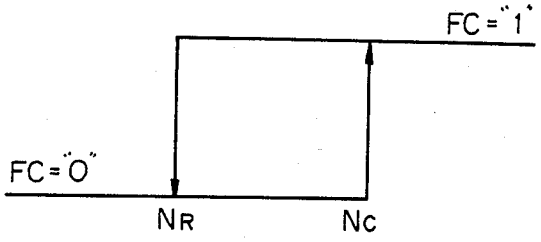
FIG. 4 is a graph showing the hysteresis characteristics of the fuel cut-off flag FC of FIG. 3.

FIG. 3 is a fuel cut-off routine executed at every predetermined time period, such as 4 ms. Here, FC is a fuel cut-off flag which has the hysteresis characteristics as shown in FIG. 4, and CFC0 is a counter for counting the duration of the fuel cut-off state. In FIG. 4 note that $N_c$ is a fuel cut-off engine speed, and $N_e$ is a fuel cut-off recovery engine speed.

At step 301, it is determined whether or not the idle switch 6 is on (LL = "1"), i.e., whether or not the throttle valve 5 is completely closed. If LL = "0", the control proceeds to step 305, in which the fuel cut-off flag FC is reset, while if LL = "1", the control proceeds to steps 302 and 303.

At step 302, it is determined whether or not the current engine speed $N_e$ stored in the RAM 108 is larger than the fuel cut-off engine speed $N_c$. At step 303, it is determined whether or not the current engine speed $N_e$ stored in the RAM 108 is smaller than the fuel cut-off recovery engine speed $N_R$. As a result, if $N_e \geqq N_c$, the control proceeds to step 304, in which the fuel cut-off flag FC is set, while if $N_e \leqq N_R$, the control proceeds to step 305, in which the fuel cut-off flag FC is reset. In addition, if $N_R < N_e < N_c$, the control proceeds directly to step 306. That is, if $N_R < N_e < N_c$, the fuel cut-off flag FC remains at the previous value.

At step 306, it is determined whether or not FC = "1" is satisfied, i.e., the fuel cut-off is carried out. If the fuel cut-off is carried out, the control proceeds to step 307, in which the counter CFC0 is counted up by +1. Otherwise, the control proceeds directly to step 308.

Figure 5:
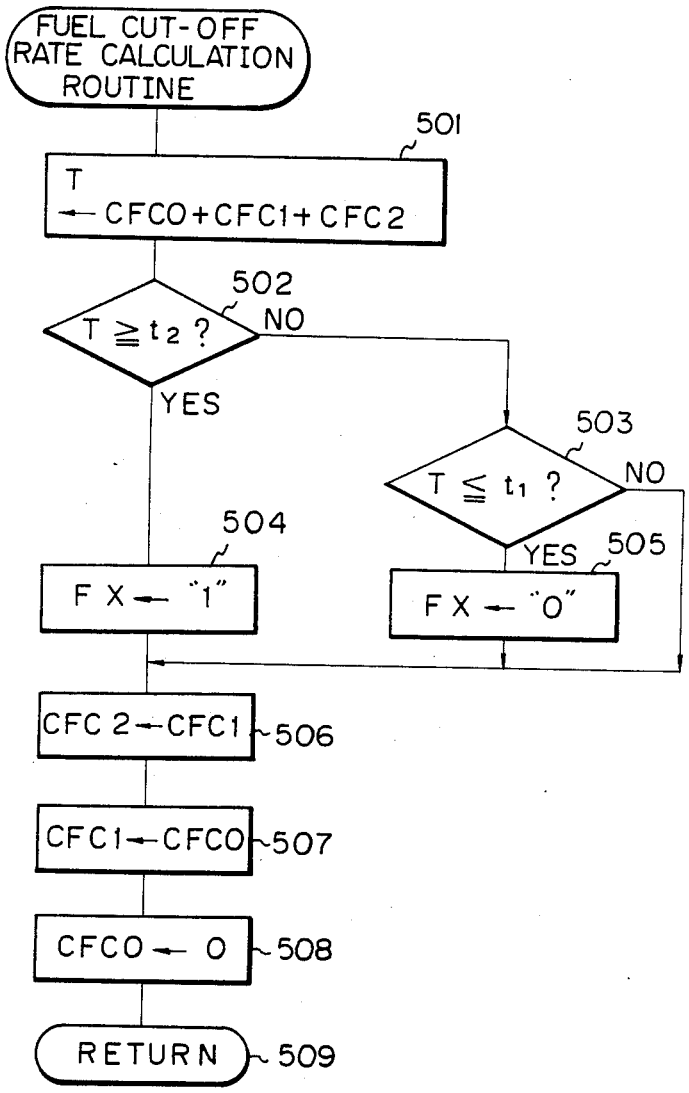

Note the counter CFC0 represents the accumulated time of the fuel cut-off per one minute, since the counter CFC0 is cleared by the one-minute routine of FIG. 5.

Then, the routine of FIG. 3 is completed by step 308.

FIG. 5 is is a fuel cut-off rate calculation routine executed at every predetermined time period, such as one minute.

At step 501, the following calculation is carried out:

$$T \leftarrow CFC0 + CFC1 + CFC2$$

where CFC1 is the value of the counter CFC0 at the previously executed cycle, i.e., one minute before, and CFC2 is the value of the counter CFC0 at the further previously executed cycle, i.e., two minutes before. Therefore, T is the accumulated time of the fuel cut-off state for every three minutes.

Figure 6:
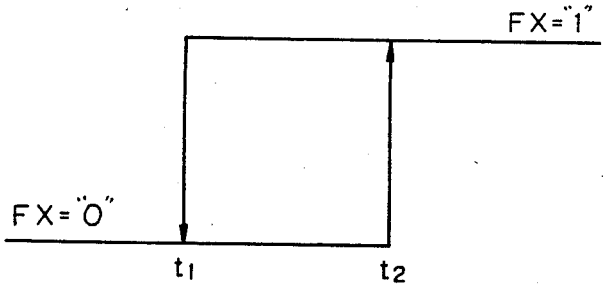
FIG. 6 is a graph showing the hysteresis characteristics of the feedback stop flag FX of FIG. 5.

Here, FX is an air-fuel ratio feedback stop flag which has hysteresis characteristics in response to the accumulated time period T as shown in FIG. 6. In FIG. 6, $t_1$ and $t_2$ are definite values.

At step 502, it is determined whether or not $T \geqq t_2$ is satisfied. Here, $t_2$ is, for example, 1 minute. At step 503, $T \leqq t_1$ is satisfied. Here, $t_1$ is, for example, 0.1 minute. As a result, if $T \geqq t_2$, the control proceeds to step 504, in which the stop flag FX is set, while if $T \leqq t_1$, the control proceeds to step 505, in which the stop flag FX is reset. In addition, if $t_1 < T < t_2$, the control proceeds directly to step 506.

At step 506, the value CFC2 is replaced by the value CFC1, at step 507, the value CFC1 is replaced by the content of the counter CFC0, and at step 508, the counter CFC0 is cleaned, in order to prepare for the next execution of this routine.

The routine of FIG. 5 is completed by step 509.

Thus, the air-fuel ratio feedback control stop flag FX is set in accordance with the accumulated time T of the fuel cut-off state for every three minutes based upon the hysteresis characteristics of FIG. 6.

Figure 7:
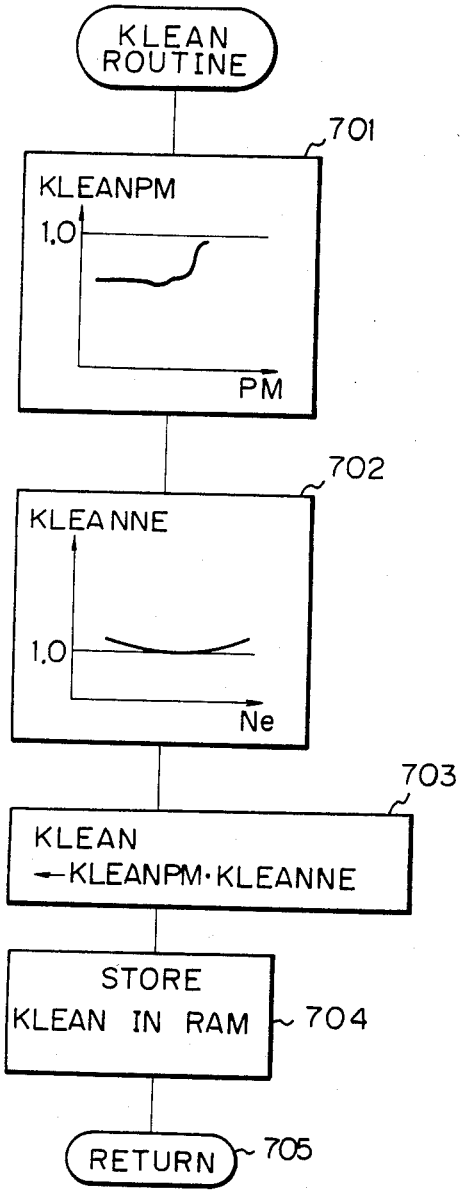

FIG. 7 is a routine for calculating a lean air-fuel ratio correction coefficient KLEAN executed at every predetermined time period. Note that the coefficient KLEAN satisfies the condition: KLEAN $\leqq$ 1.0.

At step 701, KLEANPM is calculated from a one-dimensional map stored in the ROM 107 by using the parameter PM as shown in the block of step 701. Also, at step 702, KLEANNE is calculated from a one-dimensional map stored in the ROM 107 by using the parameter Ne as shown in the block of step 702. Then at step 703,

KLEAN←KLEANPM·KLEANNE.

Thus, the finally obtained lean air-fuel ratio correction coefficient KLEAN is stored in the RAM 108 at step 704. The routine of FIG. 7 is completed by step 705.

Figure 8A:
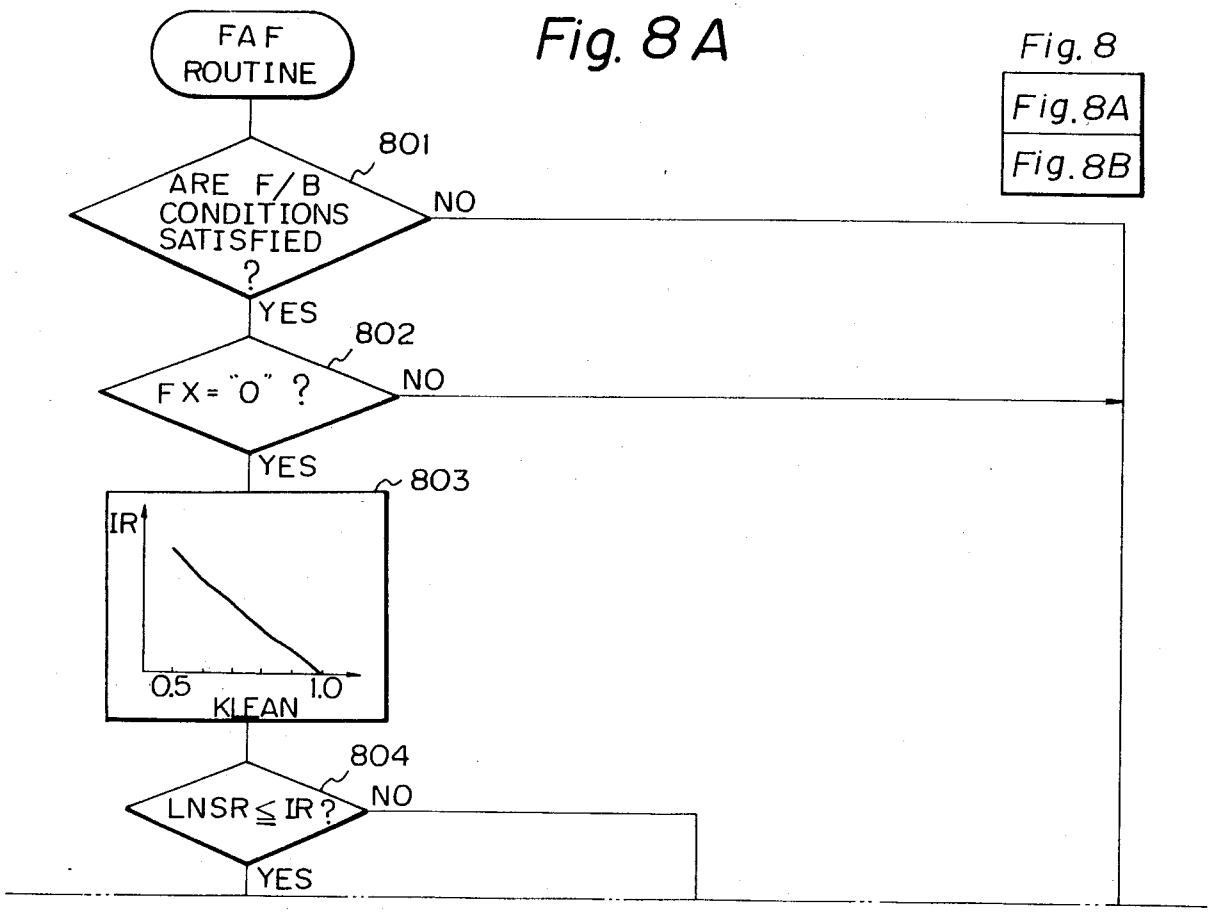
Figure 8B:
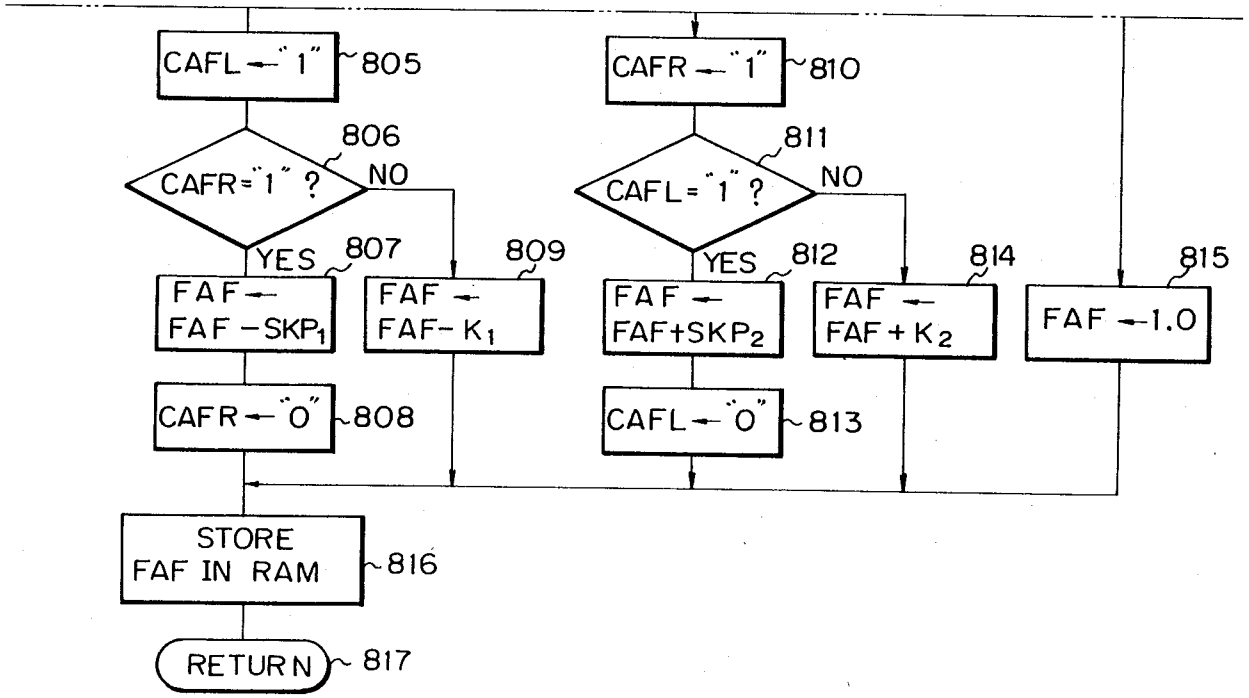

FIG. 8 is a routine for calculating an air-fuel ratio feedback correction coefficient FAF executed at every predetermined time period.

At step 801, it is determined whether or not all the feedback feedback control (closed-loop control) conditions are satisfied. The control conditions are as follows:

(i) the engine is not in a starting state;

(ii) the incremental fuel injection is not being carried out;

(iii) the coolant temperature THW is higher than a predetermined temperature; and (iv) fuel cut-off is not carried out.

Of course, other feedback control conditions are introduced as occasion demands. However, an explanation of such other feedback control conditions is omitted.

If at least one of the feedback control conditions is not satisfied, the control proceeds to step 815 in which the coefficient FAF is caused to be 1.0 (FAF =1.0), thereby carrying out an open-loop control operation. Contrary to this, if all the feedback control conditions are satisfied, the control proceeds to step 802.

At step 802, it is determined whether or not the air-fuel ratio feedback control stop flag FX is "1". If the flag FX is "1", the control proceeds to step 815, thereby carrying out an open-loop control operation.

At step 803, a comparison reference value IR is calculated from a one-dimensional map stored in the ROM 107 by using the parameter KLEAN obtained by the routine of FIG. 7. Note that this one-dimensional map is shown in the block of step 803. That is, the comparison reference value IR is variable in accordance with the coefficient KLEAN, thereby changing the aimed air-fuel ratio of the feedback control in accordance with the coefficient KLEAN.

At step 804, the output LNSR of the lean mixture sensor 13 stored in the RAM 108 is compared with the comparison reference value IR, thereby determining whether the current air-fuel ratio is on the rich side or on the lean side with respect to the aimed air-fuel ratio. If LNSR ≦IR so that the current air-fuel ratio is on the rich side, the control proceeds to step 805 in which a lean skip flag CAFL is set, i.e., CAFL←"1". Note that the lean skip flag CAFL is used for a skip operation when a first change from the rich side to the lean side occurs in the controlled air-fuel ratio.

At step 806, it is determined whether or not a rich skip flag CAFR is "1". Note that the skip flag CAFR is used for a skip operation when a first change from the lean side to the rich side occurs in the controlled air-fuel ratio. As a result, if the rich skip flag CAFR is "1", the control proceeds to step 807, which decreases the coefficient FAF by a relatively large amount $SKP_1$. Then, at step 808, the rich skip flag CAFR is cleared, i.e., CAFR←"0". Thus, when the control at step 806 is further carried out, the the control proceeds to step 809, which decreases the coefficient FAF by a relatively small amount $K_1$. Here, $SKP_1$ is a constant for a skip operation which remarkably decreases the coefficient FAF when a first change from the lean side (LNSR>IR) to the rich side (LNSR≦IR) occurs in the controlled air-fuel ratio, while $K_1$ is a constant for an integration operation which gradually decreases the coefficient FAF when the controlled air-fuel ratio is on the rich side.

On the other hand, at step 804, if LNSR>IR so that the current air-fuel rate is on the lean side, the control proceeds to step 810 in which the rich skip flag CAFR is set, i.e., CAFR←"1". Then, at step 811, it is determined whether or not the lean skip flag CAFL is "1". As a result, if the lean skip flag CAFL is "1", the control proceeds to step 812, which increases the coefficient FAF by a relatively large amount $SKP_2$. Then, at step 813, the lean skip flag CAFL is cleared, i.e., CAFL←"0". Thus, when the control at step 811 is further carried out, then the control proceeds to step 814, which increases the coefficient FAF by a relatively small amount $K_2$. Here, $SKP_2$ is a constant for a skip operation which remarkably increases the coefficient FAF when a first change from the rich side (LNSR≦IR) to the lean side (LNSR>IR) occurs in the controlled air-fuel ratio, while $K_2$ is a constant for an integration operation which gradually increases the coefficient FAF when the controlled air-fuel ratio is on the lean side.

The air-fuel feedback correction coefficient FAF obtained at steps 807, 809, 812, 814, or 815 is stored in the RAM 108, and the routine of FIG. 8 is completed by step 817.

Figure 9:
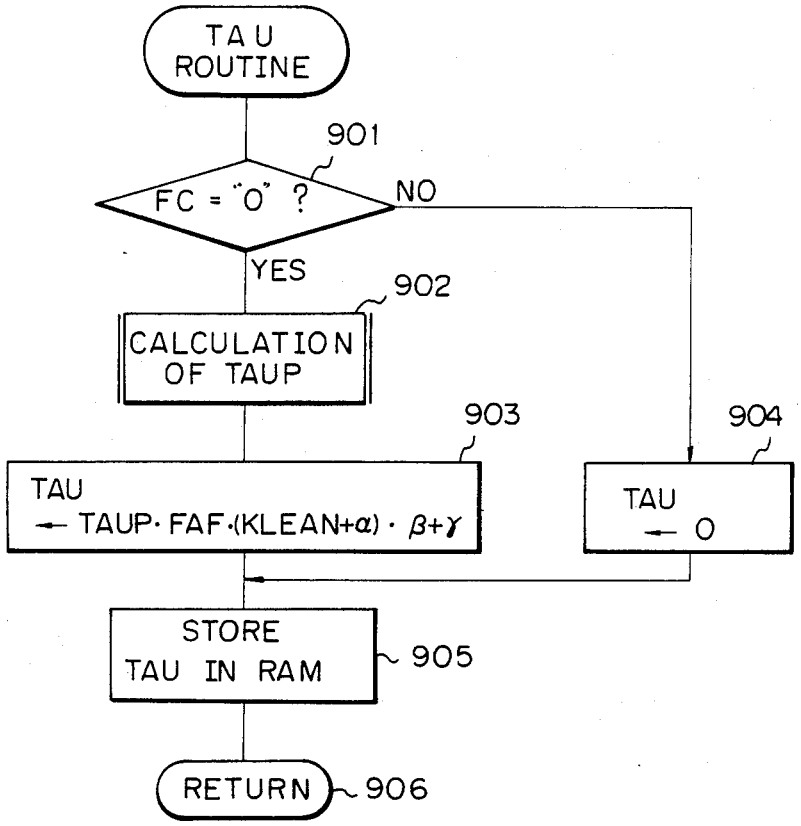

FIG. 9 is a routine for calculating a fuel injection time period TAU executed at every predetermined crank angle. For example, this routine is executed at every 360° CA in a simultaneous fuel injection system for simultaneously injecting all the injectors and is executed at every 180° CA in an sequential fuel injection system applied to a four-cylinder engine for sequentially injecting the injectors thereof.

At step 901, it is determined whether or not the fuel cut-off flag FC is "0". If the flag FC is "1", the control proceeds to step 904 in which a fuel injection time period TAU is cleared. Otherwise, the control proceeds to step 902.

At step 902, a base fuel injection time period TAUP is calculated from a two-dimensional map stored in the ROM 107 by using the parameters PM and Ne. Then, at step 903, the fuel injection time period TAU is calculated by $$TAU \leftarrow TAUP \cdot FAF \cdot (KLEAN + \alpha) \cdot \beta + \gamma$$

wherein $\alpha$, $\beta$, and $\gamma$ are correction factors determined by other parameters such as the signal of the intake air temperature sensor, the voltage of the battery (both not shown), and the like. At step 905, the calculated fuel injection time period TAU at step 903 and 904 is stored on the RAM 108, and the routine of FIG. 9 is completed by step 906.

FIG. 10 is a routine for controlling the fuel injection in accordance with the fuel injection time period TAU calculated by the routine of FIG. 9, executed at every predetermined crank angle. Also, this routine is executed at every 360° CA in a simultaneous fuel injection system and is executed at every 180° CA in an sequential fuel injection system applied to a fourcylinder engine.

At step 1001, it is determined whether or not the fuel cut-off flag FC is "0". If the flag FC is "1", the control proceeds directly to step 1010. Otherwise, the control proceeds to step 1002.

At step 1002, the fuel injection time period TAU stored in the RAM 108 is read out and is transmitted to the D register (not shown) included in the CPU 105. At step 1003, an invalid fuel injection time period TAUV which is also stored in the RAM 108 is added to the content of the D register. In addition, at step 1004, the current time CNT of the free-run counter of the timer counter 106 is read out and is added to the content of the D register, thereby obtaining an injection end time $t_e$ in the D register. Therefore, at step 1005, the content of the D register is stored as the injection end time $T_e$ in the RAM 108.

Again at step 1006, the current time CNT of the free-run counter is read out and is set in the D register. Then, at step 1007, a small time period $t_0$, which is definite or determined by the predetermined parameters, is added to the content of the D register. At step 1008, the content of the D register is set in the compare register of the timer counter 106, and at step 1009, a fuel injection execution flag and a compare interrupt permission flag are set in the registers of the timer counter 106. Then, the routine of FIG. 11 is completed by step 1000.

Thus, unless FC ="1", when the current timer CNT of the free-run counter reaches the compare register, an injection-on signal due to the presence of the fuel injection execution flag is transmitted from the time counter 106 via the I/O interface 103 to the driver circuit 104, thereby initiating a fuel injection by the fuel injector 11. Simultaneously, a compare interrupt signal due to the presence of the compare interrupt permission flag is transmitted from the timer counter 106 to the CPU 105, thereby initiating a compare interrupt routine as illustrated in FIG. 11.

The completion of the fuel injection will be explained with reference to FIG. 11. At step 1101, the injection end time $t_e$ stored in the RAM 108 is read out and is transmitted to the D register. Then, at step 1102, the content of the D register, i.e., the injection end time $t_e$ is set in the compare register of the timer counter 106, and at step 1103, the fuel injection execution flag and the compare interrupt permission flag are reset. Then, the routine of FIG. 11 is completed by step 1104.

Thus, when the current time CNT of the free-run counter reaches the compare register, an injection-off signal due to the absence of the fuel injection execution flag is transmitted from the timer counter 106 via the I/O interface 103 to the driver circuit 104, thereby ending the fuel injection by the fuel injector 11. In this case, however, no compare interrupt signal is generated due to the absence of the compare interrupt permission flag.

Thus, fuel injection of the fuel injector 11 is carried out for the time period TAU.

Note that the present invention can be also applied to a fuel injection system using other parameters such as the intake air amount and the engine speed or the throttle opening value and the engine speed.

As explained above, according to the present invention, when the fuel cut-off rate becomes high, the air-fuel feedback control by the lean mixture sensor is stopped, preventing the air-fuel ratio from being on the lean side, thus avoiding misfires or surging of the engine.

We claim:

1. A method for controlling an air-fuel ratio in an internal combustion engine having a throttle valve therein, comprising the steps of:

detecting a concentration of a specific composition in an exhaust gas of the engine;

calculating a predetermined target air-fuel ratio with respect to a stoichiometric air-fuel ratio in accordance with first predetermined parameters of said engine;

controlling a feedback of the air-fuel ratio of said engine in accordance with the detected concentration of the specific composition so that the air-fuel ratio of said engine is brought close to the predetermined target air-fuel ratio;

performing a fuel cut-off operation upon said engine in accordance with second predetermined parameters of said engine;

calculating a fuel cut-off ratio as a total time of fuel cut-off operation of the engine during a definite time period;

determining whether the fuel cut-off ratio is larger than a predetermined value; and stopping the feedback control of the air-fuel ratio of said engine when the fuel cut-off ratio is larger than the predetermined value.

2. A method as set forth in claim 1, wherein said fuel cut-off performing step comprises the steps of:

determining whether the throttle valve is completely closed;

determined whether the current engine speed is higher than a predetermined fuel cut-off engine speed;

determining whether the current engine speed is lower than a predetermined fuel cut-off recovery engine speed;

performing a fuel cut-off operation upon said engine when the throttle valve is completely closed and the current engine speed is higher than the fuel cut-off engine speed;

prohibiting fuel cut-off operation upon said engine when one of: (1) the throttle valve is not completely closed, and (2) when the throttle valve is completely closed and the current engine speed is lower than the fuel cut-off recovery engine speed; and selectively performing a fuel cut-off operation upon said engine in accordance with the previous state of said engine speed when the throttle valve is completely closed and the current engine speed is between the fuel cut-off engine speed and the fuel cut-off recovery engine speed.

3. A method as set forth in claim 1, wherein said determining step comprises the steps of:

determining whether the rate of fuel cut-off is larger than a first definite value;

determining whether the rate of fuel cut-off is smaller than a second definite value which is smaller than the first value;

considering that the rate of fuel cut-off time is larger than the predetermined value, when the rate of fuel cut-off time is larger than the first definite value;

considering that the rate of fuel cut-off time is not larger than the predetermined value, when the rate of fuel cut-off time is smaller than the second definite value; and holding the previous determination result, when the rate of fuel cut-off time is between the first and second values.

4. An apparatus for controlling the air-fuel ratio in an internal combustion engine having a throttle valve therein comprising:

means for detecting the concentration of a specific composition in the exhaust gas;

means for calculating an predetermined target air-fuel ratio with respect to a stoichiometric air-fuel ratio in accordance with first predetermined parameters of said engine;

means for controlling a feedback loop of the air-fuel ratio of said engine in accordance with the detected concentration of the specific composition so that the air-fuel ratio of said engine is brought close to the predetermined target air-fuel ratio;

means for performing a fuel cut-off operation upon said engine in accordance with second predetermined parameters of said engine;

means for calculating a fuel cut-off ratio by determining a total time of fuel cut-off operation of the engine during a definite time period;

means for determining whether the fuel cut-off ratio is larger than a predetermined value; and means for stopping the feedback control of the air-fuel ratio of said engine when the fuel cut-off ratio is larger than the predetermined value.

5. An apparatus as set forth in claim 4, wherein said fuel cut-off means comprises:

means for determining whether the throttle valve is completely closed;

means for determining whether the current engine speed is higher than a predetermined fuel cut-off engine speed;

means for determining whether the current engine speed is lower than a predetermined fuel cut-off recovery engine speed;

means for performing a fuel cut-off operation upon said engine when the throttle valve is completely closed and the current engine is higher than the fuel cut-off engine speed;

means for prohibiting fuel cut-off operation upon said engine when the throttle valve is not completely closed, or when the throttle valve is completely closed and the current engine speed is lower than the fuel cut-off recovery engine speed; and means for selectively performing a fuel cut-off operation upon said engine in accordance with the previous state of said engine when the throttle valve is completely closed and the current engine speed is between the fuel cut-off engine speed and the fuel cut-off recovery engine speed.

6. An apparatus as set forth in claim 4, wherein said determining means comprises:

means for determining whether the rate of fuel cut-off time is larger than a first definite value;

means for determining whether the rate of fuel cut-off time is smaller than a second definite value which is smaller than the first value;

means for considering that the rate of fuel cut-off time is larger than the predetermined value when the rate of fuel cut-off time is larger than the first definite value;

means for considering that the rate of fuel cut-off time is not larger than the predetermined value when the rate of fuel cut-off time is smaller than the second definite value; and means for holding the previous determination result, when the rate of fuel cut-off time is between the first and second values.

* * * * *